US010293629B2

(12) United States Patent
Philippe et al.

(10) Patent No.: US 10,293,629 B2
(45) Date of Patent: May 21, 2019

(54) DOCUMENT COMPRISING AT LEAST TWO PHOTOLUMINESCENT IMAGES, SECURITY FILM AND PROTECTIVE SECURITY METHOD

(71) Applicant: FASVER, Baillargues (FR)

(72) Inventors: Eric Philippe, Eyguieres (FR); Laurence Bes, Jacou (FR)

(73) Assignee: FASVER, Baillargues (FR)

( * ) Notice: Subject to any disclaimer, the term of this patent is extended or adjusted under 35 U.S.C. 154(b) by 109 days.

(21) Appl. No.: 15/128,538

(22) PCT Filed: Mar. 23, 2015

(86) PCT No.: PCT/EP2015/056141
§ 371 (c)(1),
(2) Date: Sep. 23, 2016

(87) PCT Pub. No.: WO2015/144646
PCT Pub. Date: Oct. 1, 2015

(65) Prior Publication Data

US 2017/0106691 A1 Apr. 20, 2017

(30) Foreign Application Priority Data

Mar. 24, 2014 (FR) ..... 1452465

(51) Int. Cl.
*B42D 25/387* (2014.01)
*B42D 25/47* (2014.01)
(Continued)

(52) U.S. Cl.
CPC ..... *B42D 25/387* (2014.10); *B41M 3/144* (2013.01); *B42D 25/36* (2014.10); *B42D 25/47* (2014.10); *B42D 2035/34* (2013.01)

(58) Field of Classification Search
CPC ..... B42D 25/387; B42D 25/47; B42D 25/36; B42D 2035/34; B41M 3/144
(Continued)

(56) References Cited

U.S. PATENT DOCUMENTS 6,494,490 B1 12/2002 Trantoul
2004/0245763 A1* 12/2004 Trantoul ..... G09F 3/0292 283/72

FOREIGN PATENT DOCUMENTS

EP 2 075 767 A1 7/2009
FR 2 834 484 A1 7/2003
(Continued)

OTHER PUBLICATIONS

International Search Report, dated Jun. 10, 2015, from corresponding PCT application.

*Primary Examiner* — Justin V Lewis
(74) *Attorney, Agent, or Firm* — Levenfeld Pearlstein, LLC

(57) ABSTRACT

A document (15) includes at least:

Figure 1:
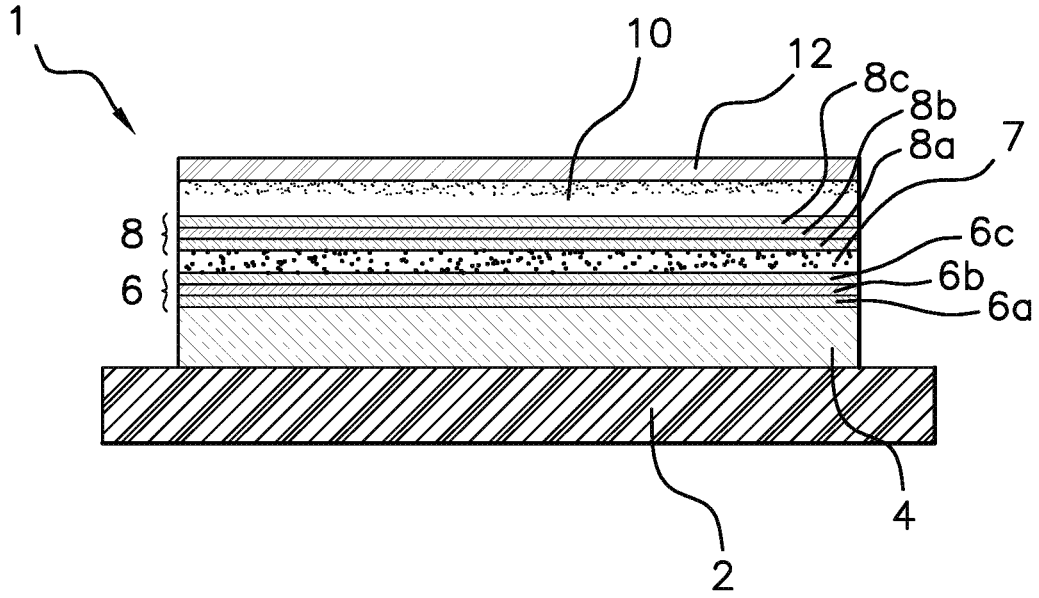

one first image (5) including at least one photoluminescent pigment which is invisible under illumination in visible light and is visible under illumination by at least one first source (20) of non-visible light emitting in the short ultraviolet domain, one second image including at least one photoluminescent pigment which is invisible under illumination in visible light and is visible under illumination by at least one second source of non-visible light emitting in the long ultraviolet domain, one layer, named a filtering layer, arranged facing the second image and including at least one material, named a filtering material, suitable for allowing the wavelengths emitted by the first source of non-visible
(Continued)

light to be filtered without preventing the first image from being seen under illumination by the first light source.

7 Claims, 2 Drawing Sheets

(51) Int. Cl.
*B41M 3/14* (2006.01)
*B42D 25/36* (2014.01)

(58) Field of Classification Search
USPC ..... 283/67, 70, 72, 74, 88, 89, 91, 94, 114, 283/901
See application file for complete search history.

(56) References Cited

FOREIGN PATENT DOCUMENTS

| | | | | | |
|---|---|---|---|---|---|
| WO | 00/24587 | A1 | | 5/2000 | |
| WO | 03/036595 | A2 | | 5/2003 | |
| WO | WO-2009083570 | A1 | * | 7/2009 | ..... G07D 7/12 |
| WO | 2013/020983 | A1 | | 2/2013 | |

* cited by examiner

DOCUMENT COMPRISING AT LEAST TWO PHOTOLUMINESCENT IMAGES, SECURITY FILM AND PROTECTIVE SECURITY METHOD

The invention relates to a document, in particular an official document, comprising at least two images each comprising at least one photoluminescent pigment, a security film comprising such images, and a protective security method for such a document.

Throughout the text, the term "visible light" is understood to mean any light whose spectral composition is at least partially located in the visible domain, from 0.4 μm to 0.8 μm. Throughout the text, the term "non-visible light" is understood to mean any light whose spectral composition is located outside of the visible spectrum, in particular in the ultraviolet and/or infrared spectrum.

Throughout the text, the term "short-wave ultraviolet light" is understood to mean any light whose spectral composition is located in the wavelength domain between 100 nm and 300 nm, and in particular between 200 nm and 300 nm.

Throughout the text, the term "long-wave ultraviolet light" is understood to mean any light whose spectral composition is located in the wavelength domain between 300 nm and 400 nm.

Throughout the text, the term "photoluminescent" is understood to mean any pigment (or any image) suitable for emitting at least one visible radiation in response to illumination by at least one source of invisible light emitting in the ultraviolet and/or infrared domain.

There are known numerous protective security methods and devices for official documents (passports, visas, identity cards, driving licenses, log books, bank cards, diplomas, certificates, transport documentation, access control cards, badges, labels, legal documents, contracts, land registry documents, manufacturing drawings or other plans . . . ) having markings, in particular markings to be read such as variable details (surname, first name, address, photo, . . . of a holder or parties . . . ) and/or common details (security patterns, character boxes, frames, names of fields, seals, holograms, . . . ) which should be protected against falsification attempts and/or counterfeits and/or for authentication and/or for ensuring the integrity thereof (i.e. the fact that they have not been altered or modified).

Monochromatic or polychromatic, photoluminescent, printed markings which are invisible under illumination in visible light and are visible under illumination by at least one source of non-visible light (ultraviolet or infrared for example) are often used for authenticating such official documents such as passports or bank notes.

WO 00/24587 describes, for example, a method of making a polychromatic, photoluminescent, printed image which is invisible under illumination in visible light and is visible under illumination by at least one source of non-visible light, as well as a device for protecting such a document comprising at least one such image. WO 00/24587 also describes the possibility of preparing an image comprising different pigments whose absorption spectra may be different, for example photoluminescent pigments whose absorption spectrum is in the long ultraviolet domain and/or photoluminescent pigments whose absorption spectrum is in the short ultraviolet domain and/or photoluminescent pigments whose absorption spectrum is in the infrared domain. Several different sources of non-visible light are thus necessary and must be used simultaneously to be able to view the single prepared image.

However, in the field of rendering official documents secure, it appears to be necessary to further increase the security and authentication levels of such a device, in particular by using images sensitive to short-wave ultraviolet light and images sensitive to long-wave ultraviolet light on a single document. However, the inventors have noted that when an image visible under long-wave ultraviolet light and an image visible under short-wave ultraviolet light are at least partially superposed, the image visible under short-wave ultraviolet light is often poorly rendered. It is thus not possible to effectively inspect an image which is visible under short-wave ultraviolet light, i.e. an image comprising pigments which are photoluminescent under illumination by a source of non-visible light emitting in the short ultraviolet domain when another image visible under long-wave ultraviolet light, i.e. an image comprising pigments which are photoluminescent under illumination by a source of non-visible light emitting in the long ultraviolet domain, is applied on the same document, one next to the other or in particular when they are at least partially superposed. In fact, it has been shown that an image sensitive to long-wave ultraviolet light is also activated (at least partially visible) under illumination by a source of non-visible light emitting in the short ultraviolet domain.

On the other hand, there is known from EP 2 075 767 a device for document authentication comprising at least two juxtaposed zones, each printed using an ink containing fluorescent pigments, these two juxtaposed zones covering at least one third zone likewise printed using an ink containing fluorescent pigments. Under a first ultraviolet radiation, the two juxtaposed zones form a filter for the radiation emitted towards or retransmitted by the third zone which remains invisible, whereas under a second ultraviolet radiation the third zone is visible. However, EP 2 075 767 does not describe a document comprising an image sensitive to short-wave ultraviolet light and also an image sensitive to long-wave ultraviolet light, nor how to prepare such a document.

Therefore, the invention aims to overcome the disadvantages of the known protective devices and to propose a document, in particular an official document, and a security film having an increased level of security.

The invention likewise aims to propose a protective security method for a document, in particular an official document, which is simple, reliable and less complex allowing the reproduction of images, in particular images which are polychromatic in origin, and the improvement of the level of security and the authentication of a document, in particular an official document.

To this end, the invention relates to a document, in particular an official document, comprising:

- at least one first image which is invisible under illumination in visible light and is visible under illumination by at least one first source of non-visible light emitting in the short ultraviolet domain, said first image comprising at least one pigment which is photoluminescent under illumination by said first source of non-visible light, characterised in that it further comprises:

- at least one second image which is invisible under illumination in visible light and is visible under illumination by at least one second source of non-visible light emitting in the long ultraviolet domain, said second image comprising at least one pigment which is photoluminescent under illumination by said second source of non-visible light, at least one layer, named a filtering layer, superposed on said second image and comprising at least one material, named a filtering material, suitable for allowing the wavelengths emitted by said first source of non-visible light to be filtered without preventing the first image from being seen under illumination by the first light source.

The inventors have surprisingly noted that by arranging such a filtering layer facing an image which is visible under illumination by a source of light emitting in the long ultraviolet domain, it is possible to obtain a first high-quality image which is visible under illumination by at least one source of non-visible light emitting in the short ultraviolet domain.

Therefore, it is now possible to arrange an image which is visible under long-wave ultraviolet light and an image which is visible under short-wave ultraviolet light at least partially one above the other or at least partially juxtaposed on a single document, which—in practice—was not possible previously.

The invention thus allows two different images to be produced on a single document, one image being visible under short-wave ultraviolet light and the other image being visible under long-wave ultraviolet light, by arranging a filtering layer as defined previously facing the image which is invisible under illumination in visible light and is visible under illumination by at least one source of non-visible light emitting in the long ultraviolet domain.

It is thus possible to increase the number of authentication levels since a first illumination by at least one first source of non-visible light emitting in the short ultraviolet domain allows the selective verification of the presence of a first image without viewing other interfering patterns; and a second illumination by at least one second source of non-visible light emitting in the long ultraviolet domain allows the selective verification of the presence of a second image without viewing other interfering patterns, the two images being selectively visible with a very high level of quality. This thus allows the authentication of a document to be verified by observing alternatively a first image under illumination by at least one first source of non-visible light emitting in the short ultraviolet domain, and a second image under illumination by at least one second source of non-visible light emitting in the long ultraviolet domain.

Advantageously and in accordance with the invention, said first image and said second image are two separate images, i.e. they are each formed by at least one printing layer which are different from each other.

Advantageously and in accordance with the invention, the first source of non-visible light and the second source of non-visible light emit in at least partly different wavelength domains. In this manner, by choosing, for the first image and the second image respectively, photoluminescent pigments having different excitation wavelengths, it is possible to prepare two quality images (one being visible under excitation by short-wave ultraviolet light and the other being visible under excitation by long-wave ultraviolet light) which can be observed independently of each other (and not only simultaneously).

Advantageously and in accordance with the invention, a document in accordance with the invention is an official document or a security document selected from the group formed of documents comprising identity data (such as passports, identity card, driving license or even visas), documents issued by an official administration and documents comprising security data (such as bank cards or even controlled access badges).

A document in accordance with the invention, in particular an official document in accordance with the invention, generally bears markings (or "markings to be read"), i.e. any sign or pattern formed on the document, which can be read by a person at least under certain conditions (in particular under normal illumination in visible light; and/or under specific illumination; and/or after activation of an electronic device (screen) or the like . . . ). This may be text (handwriting or printed characters); codes (ASCII, universal codes to be read optoelectronically such as barcodes . . . ); images or photographs . . . .

Any type of document can be used. These may be documents based on cellulose materials (papers, card, . . . ) or based on polymer materials which are rigid or flexible.

Advantageously and in accordance with the invention, said filtering layer is suitable for allowing wavelengths less than 300 nm, in particular wavelengths between 100 nm and 300 nm, in particular wavelengths between 200 nm and 300 nm, to be filtered.

Advantageously and in accordance with the invention, said filtering layer is suitable for not blocking wavelengths emitted by the second source of non-visible light, in particular wavelengths greater than 300 nm, in particular wavelengths between 300 nm and 400 nm.

In particular, the filtering layer can be formed from at least one material selected from thermoplastic and thermosetting polymeric materials, in particular photocurable polymeric materials. In a first variant, the filtering layer comprises at least one polymer material selected from the group formed of polymer materials suitable for filtering short-wave ultraviolet light, and in particular from the group formed of thermoplastic polymeric materials (in particular polycarbonates, polyesters and polyvinyl chloride (PVC)), thermosetting polymeric materials (in particular polyurethanes) and photocurable polymeric materials (in particular functionalised acrylic resins which are cross-linked or polymerised under ultraviolet radiation or under electron irradiation). In fact, it is possible to choose from among these polymers those ones which have a crystallinity and optionally a rate of unsaturated carbon-carbon bonds which are suitable for filtering short-wave ultraviolet light while remaining transparent to visible light. In particular, the filtering layer comprises at least one polymer material selected from the group formed of polymer materials having a transmittance of less than 30% at wavelengths of less than 300 nm. The transmittance can be measured using a UV-visible spectrophotometer.

In a second variant, the filtering layer comprises at least one polymer material selected from the group formed of polymer materials comprising additives suitable for filtering short-wave ultraviolet light, and in particular from the group formed of acrylate and/or methacrylate polymers and copolymers to which are added filtering additives selected from among the additives filtering short-wave ultraviolet light such as those of the family of 2-(2-hydroxyphenyl)-benzotriazole (BTZ) or 2-hydroxyphenyl-s-triazine (HPT).

Other than the filtering layer, various layers such as layers comprising other security functions or markings can also be present between the first image and the second image.

The first image and the second image can be identical or different in terms of size, represented pattern(s) or even colours except for the fact that one image is visible under illumination by at least one first source of non-visible light emitting in the short ultraviolet domain and that the other image is visible under illumination by at least one second source of non-visible light emitting in the long ultraviolet domain. Advantageously and in accordance with the invention, said second image is different from said first image which allows them to be mutually identified more easily based on the source of non-visible light used.

Advantageously and in accordance with the invention, said first image and said second image are coloured images. They may be monochromatic or polychromatic. Advantageously and in accordance with the invention, said first image and said second image are polychromatic images. Advantageously and in accordance with the invention, the second image is at least partially superposed on the first image.

Advantageously and in accordance with the invention, each image is formed of additive colours.

Each image can be transparent or semi-transparent to visible light. In one particularly advantageous embodiment of a document in accordance with the invention, each image is transparent or semi-transparent. Advantageously and in accordance with the invention, each image is semi-transparent. The proportion and type of photoluminescent pigments used allow in particular the more or less transparent state for each image to be modified.

Throughout the text, the term "semi-transparent image" is understood to mean any image which, when it covers a document or product, allows underlying characters or patterns of the document to be distinguished—in particular read—when this image is viewed normally. In particular, a semi-transparent image does not totally mask the underlying characters and/or patterns of the document.

Advantageously and in accordance with the invention, each image is formed of at least one printing layer, each printing layer being obtained by printing at least one printing composition comprising at least one photoluminescent pigment. Advantageously and in accordance with the invention, each printing layer of the first image comprises, as photoluminescent pigments, only pigments which are photoluminescent under illumination by at least one first source of non-visible light emitting in the short ultraviolet domain. On the other hand, advantageously and in accordance with the invention, each printing layer of the second image comprises, as photoluminescent pigments, only pigments which are photoluminescent under illumination by at least one second source of non-visible light emitting in the long ultraviolet domain. Therefore, advantageously and in accordance with the invention, the first image does not comprise pigments which are photoluminescent under illumination by at least one source of non-visible light emitting in the long ultraviolet domain.

Advantageously and in accordance with the invention, each polychromatic image comprises a plurality of superposed monochromatic printing layers.

Advantageously and in accordance with the invention, each printing composition comprises at least one photoluminescent pigment. The photoluminescent pigments used are selected from among fluorescent pigments and phosphorescent pigments. Such pigments have an excitation spectrum extending at least partially in the ultraviolet domain and an emission spectrum extending at least partially in the visible domain. In particular, the photoluminescent pigments used are selected from among mineral pigments, in particular photoluminescent pigments comprising chemical elements belonging to the family of rare earth metals, and organic pigments, in particular organic pigments resistant to the radiation of each source of non-visible light allowing the behaviour of each image over time to be ensured. In particular, photoluminescent pigments suitable for screen printing are selected.

Advantageously and in accordance with the invention, said document comprises at least one security film, said security film incorporating at least said second image and said filtering layer.

Advantageously and in accordance with the invention, said security film covers at least one surface portion of said document and extends in a format adapted to the format of said surface portion.

The invention likewise relates to a security film, in particular a security film for obtaining such a document, said security film comprising:

- at least one first image which is invisible under illumination in visible light and is visible under illumination by at least one first source of non-visible light emitting in the short ultraviolet domain, said first image comprising at least one pigment which is photoluminescent under illumination by said first source of non-visible light, characterised in that it further comprises:

- at least one second image which is invisible under illumination in visible light and is visible under illumination by at least one second source of non-visible light emitting in the long ultraviolet domain, said second image comprising at least one pigment which is photoluminescent under illumination by said second source of non-visible light,
- at least one layer, named filtering layer, arranged facing said second image and comprising at least one material, named filtering material, suitable for allowing the wavelengths emitted by said first source of non-visible light to be filtered without preventing the first image from being seen under illumination by the first light source.

Thus, by applying, for example heat-transferring, said security film on at least one surface portion of a document, a document in accordance with the invention is obtained.

Advantageously and in accordance with the invention, said security film comprises at least one support film on which are arranged said first image and said second image, said filtering layer being arranged between said first image and said second image.

In another variant of a security film in accordance with the invention, the filtering layer and the support film form a single layer, the first image and the second image each being printed on a different face of this filtering layer being used as the support film. Advantageously and in accordance with the invention, said filtering layer forms a support film having a first face on which is arranged said first image, and a second face, different from said first face, on which is arranged said second image. The first image and the second image are thus respectively printed on one side and the other side of the support film, this support film being, in this case, suitable for allowing the wavelengths emitted by said first source of non-visible light to be filtered without preventing the first image from being seen under illumination by the first light source filtering the short-wave ultraviolet light.

The support film can be opaque or transparent. The support film can be opaque if it is intended to be removed in order to use the document, in particular the official document to be protected, after transferring the security film to the document. If it is translucent or transparent (under visible light as well as short-wave and long-wave ultraviolet light), the support film can be retained once said security film is attached to the document to be protected. The support film can be formed of at least one material selected from among cellulose materials, polymer materials and composites thereof.

Advantageously and in accordance with the invention, said support film is transparent, in particular transparent to short-wave ultraviolet light and to long-wave ultraviolet light. In this manner, the support film can form a support on which each of the images and the filtering layer are printed and also a layer protecting the outer surface of the security film, after being transferred to the document.

Various structural or functional layers (comprising, for example, other security functions or even markings) can be arranged between the support film and the first image, each layer being selected, as the case may be, so as to be at least partially transparent to short-wave ultraviolet light and to long-wave ultraviolet light (i.e. in the case where they are intended to remain on the document to be protected and thus not be removed after transferring the security film).

In one particularly advantageous embodiment variant of a document and a security film in accordance with the invention, a clear protective lacquer, in particular one which is transparent to short-wave ultraviolet light and long-wave ultraviolet light, can also be arranged on the support film. It may be for example a lacquer layer which is transparent to ultraviolet light, in particular short-wave ultraviolet light, such as the lacquers described in patent application FR 2 834 484. Such lacquers have, after curing, exclusively saturated carbon-carbon covalent bonds. Such a protective lacquer is also suitable, as the case may be, for being able to be easily separated from the support film on which it is applied upon transferring to the document.

The first image and the second image are arranged on the same document, by being juxtaposed or at least partially superposed one on the other. Each image can cover a surface portion with a different size and/or shape. They can cover all of the document or even only a limited surface portion in the manner of a logo located at a particular place on the document. Advantageously and in accordance with the invention, said second image is arranged above said first image on said support film. In this manner, the first image and the second image can be located on the same surface portion of the document, covering it at least partially and if, for example, the surface portion allocated to this security point on the document is limited (the document can already comprise other security devices or zones with markings to which it is not desired to add such images).

The invention further relates to a protective security method for at least one surface portion of a document, in particular an official document, in which:

at least one first image which is invisible under illumination in visible light and is visible under illumination by at least one first source of non-visible light emitting in the short ultraviolet domain is applied to said surface portion, said first image comprising at least one pigment which is photoluminescent under illumination by said first source of non-visible light, characterised in that:

at least one second image which is invisible under illumination in visible light and is visible under illumination by at least one second source of non-visible light emitting in the long ultraviolet domain is applied to said surface portion, said second image comprising at least one pigment which is photoluminescent under illumination by said second source of non-visible light, a layer, named filtering layer, is superposed on said second image and comprises at least one material, named filtering material, suitable for allowing the wavelengths emitted by said first source of non-visible light to be filtered without preventing the first image from being seen under illumination by the first light source.

Advantageously and in accordance with the invention, the following steps are performed in succession:

the first image is printed on a support film, the filtering layer is applied on top of the first image, the second image is printed on top of the filtering layer, an adhesive layer is applied on top of the second image.

The images of a method in accordance with the invention are prepared by a method as described in international patent application WO 00/24587.

Advantageously and in accordance with the invention, in order to apply each image, a plurality of superposed, monochromatic printing layers are printed such that, in the order of receiving the illumination light, they are in the order of blue, red, green of filtering wavelengths and emission peaks of photoluminescent pigments.

Advantageously and in accordance with the invention, in a method in accordance with the invention, the following steps are performed:

at least three monochromatic negatives are prepared, each corresponding to a first original image which is filtered in a spectral bandwidth of less than 15 nm centred in a wavelength, named filtering wavelength, selected from among the wavelengths of at least three primary colours, the pairs of different filtering wavelengths of the monochromatic negatives being separate from each other, each of these filtering wavelengths being equal to a wavelength of an emission peak of a photoluminescent pigment under illumination by at least one first source of non-visible light, at least three monochromatic negatives are prepared, each corresponding to a second original image which is filtered in a spectral bandwidth of less than 15 nm centred in a wavelength, named filtering wavelength, selected from among the wavelengths of at least three primary colours, the pairs of different filtering wavelengths of the monochromatic negatives being separate from each other, each of these filtering wavelengths being equal to a wavelength of an emission peak of a photoluminescent pigment under illumination by at least one second source of non-visible light, the second source of non-visible light having a different spectral composition than the spectral composition of the first source of non-visible light, a first polychromatic image is printed by successively printing at least three monochromatic images using—in order to print each monochromatic image—respectively one of the monochromatic negatives of said first original image and a printing composition comprising at least one photoluminescent pigment having an emission peak wavelength under illumination by at least one source of non-visible light which is equal to the filtering wavelength used to obtain said monochromatic negative, a second polychromatic image is printed by successively printing at least three monochromatic images using—in order to print each monochromatic image—respectively one of the monochromatic negatives of said second original image and a printing composition comprising at least one photoluminescent pigment having an emission peak wavelength under illumination by at least one source of non-visible light which is equal to the filtering wavelength used to obtain said monochromatic negative.

Each printing composition can be applied by any technique allowing the printing of an image comprising photoluminescent pigments. Advantageously and in accordance with the invention, each image is printed by a technique selected from screen printing, flexography, offset and photogravure.

The invention relates to a protective security method for at least one surface portion of a document, in particular an official document, in which a security film in accordance with the invention is transferred to said document.

The invention also relates to a document, in particular an official document, a security film, a protective security method and a method for making a security film, characterised in combination by all or some of the features mentioned above or hereinafter.

Figure 2:
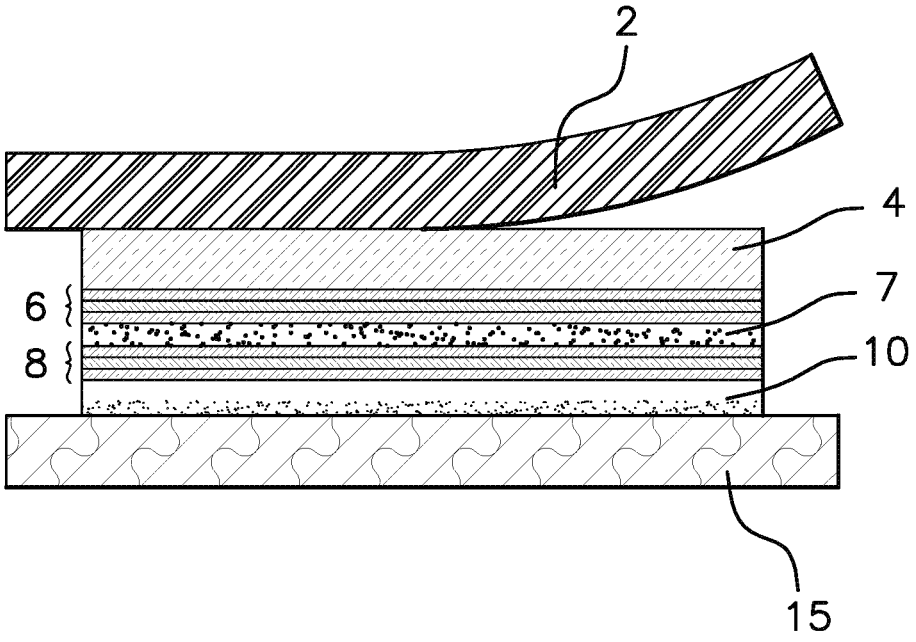
Figure 3:
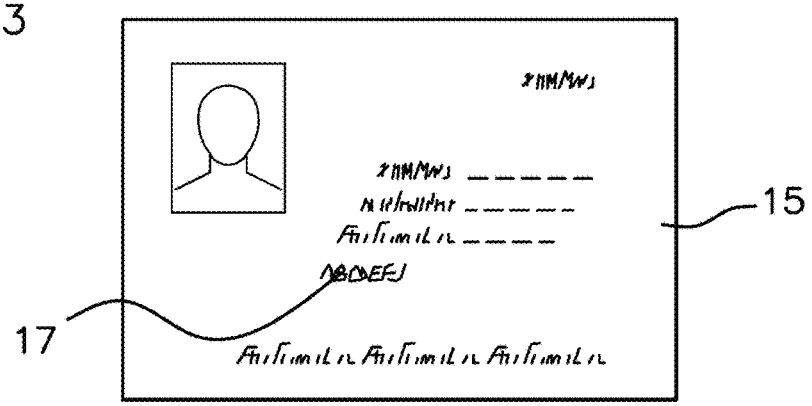
Figure 4:
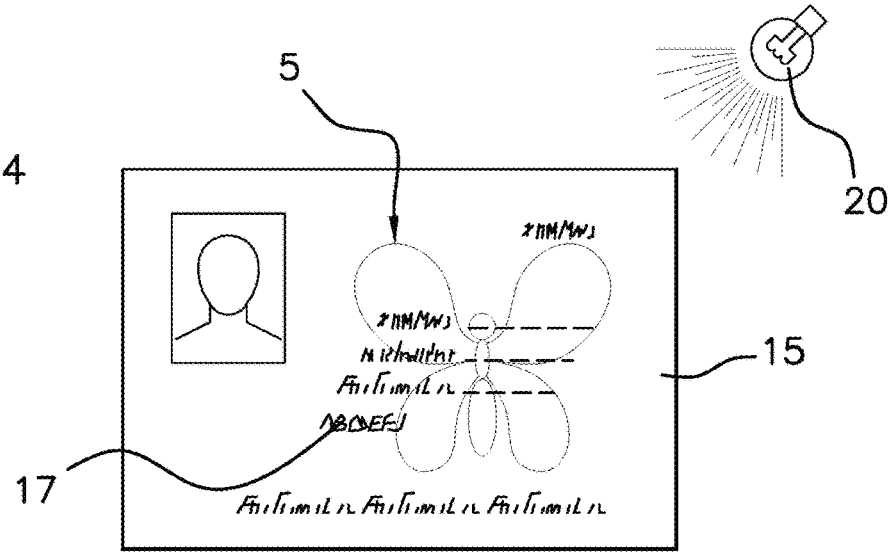
Figure 5:
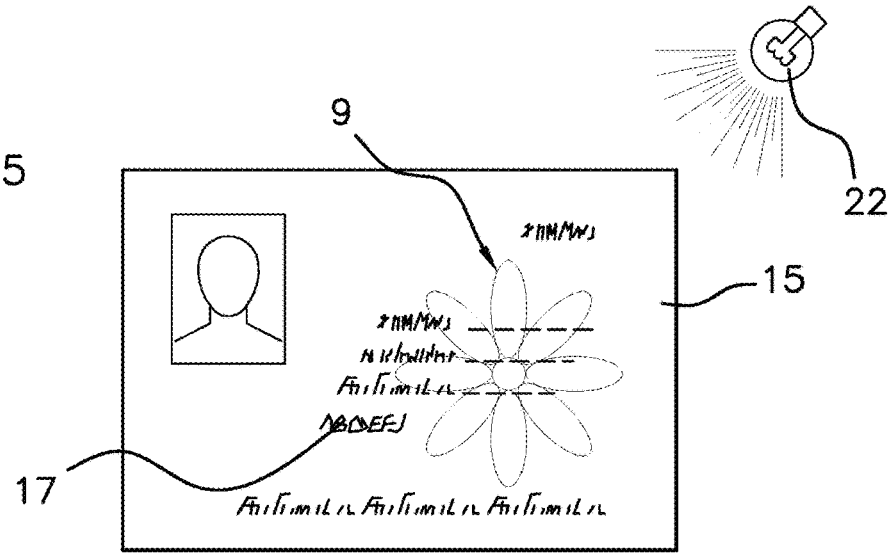

Other aims, features and advantages of the invention will become apparent upon reading the following description of one of its preferential embodiments given by way of non-limiting example, and referring to the attached figures in which:

FIG. 1 is schematic, cross-sectional view of a security film in accordance with the invention, FIG. 2 is schematic, cross-sectional view of an official document in accordance with the invention, FIGS. 3 to 5 illustrate different steps of a method in accordance with the invention.

For ease of illustration, FIGS. 1 to 5 are not shown to scale. In particular, in FIG. 1, the thicknesses are shown in an exaggerated manner.

A clear protective lacquer 4, in particular one which is transparent to short-wave ultraviolet light and to long-wave ultraviolet light, is printed on a translucent or transparent, opaque, thin support film 2 made of polymer material. The support film 2 is generally selected so as to have a size greater than that of the surface to be covered of the official document to be protected. Alternatively, the support film 2 can be opaque if it is intended to be removed after being transferred to an official document. If it is translucent or transparent (to visible light as well as to short-wave and long-wave ultraviolet light) it can be removed or retained after being transferred to the official document to be protected (the size thereof can thus be adjusted with respect to that of the surface to be covered of the official document to be protected).

Then, a first polychromatic image 5 which is invisible under illumination in visible light and is visible under illumination by at least one first source 20 of non-visible light emitting in the short ultraviolet domain, is printed using three printing compositions comprising pigments which are photoluminescent under illumination by the first source 20 of non-visible light. To this end, three printing compositions are successively printed, forming three layers 6*a*, 6*b* and 6*c*.

After having printed the image 5, a filtering layer 7 is printed directly on top of the image 5, said filtering layer being suitable for allowing the wavelengths emitted by the first source 20 of non-visible light to be filtered without preventing the first image from being seen under illumination by the first light source.

The filtering layer can be formed from at least one material selected from thermoplastic and thermosetting polymeric materials, in particular photocurable polymeric materials.

In a first variant in accordance with the invention, the filtering layer comprises at least one polymer material selected from the group formed of polymer materials suitable for filtering short-wave ultraviolet light, and in particular from the group formed of thermoplastic polymeric materials (in particular polycarbonates, polyesters and polyvinyl chloride (PVC)), thermosetting polymeric materials (in particular polyurethanes) and photocurable polymeric materials (in particular functionalised acrylic resins which are cross-linked or polymerised under ultraviolet radiation or under electron irradiation). The filtering layer comprises in particular at least one such polymer material having a transmittance (measured using a UV-visible spectrophotometer) of less than 30% at wavelengths of less than 300 nm.

In a second variant in accordance with the invention, the filtering layer comprises at least one polymer material selected from the group formed of polymer materials comprising additives suitable for filtering short-wave ultraviolet light, and in particular from the group formed of acrylate and/or methacrylate polymers and copolymers comprising filtering additives selected from among the additives filtering short-wave ultraviolet light such as those of the family of 2-(2-hydroxyphenyl)-benzotriazole (BTZ) or 2-hydroxyphenyl-s-triazine (HPT).

A second polychromatic image 9 which is invisible under illumination in visible light and is visible under illumination by at least one second source 22 of non-visible light emitting in the long ultraviolet domain, is printed directly on top of the filtering layer 7 using three printing compositions comprising pigments which are photoluminescent under illumination by the second source 22 of non-visible light. To this end, three printing compositions are successively printed, forming three layers 8*a*, 8*b* and 8*c*.

Then, an adhesive layer 10 can be applied on top of the second image 9, followed by a film 12 protecting the adhesive.

The thus obtained security film 1 can form a heat transfer, i.e. can be used to apply the security film 1 and to transfer it by hot lamination onto a surface portion of an official document 15, as shown in FIGS. 3 to 5, in particular so as to protect same against being falsified and/or to authenticate the official document and/or the variable or common markings previously printed on this surface portion and/or to ensure the integrity thereof.

A method for making a security film is thus a method in which:

- at least one first image 5 which is invisible under illumination in visible light and is visible under illumination by at least one first source 20 of non-visible light emitting in the short ultraviolet domain is printed using at least one printing composition comprising at least one pigment which is photoluminescent under illumination by said first source of non-visible light,
- at least one second image 9 which is invisible under illumination in visible light and is visible under illumination by at least one second source 22 of non-visible light emitting in the long ultraviolet domain is printed using at least one printing composition comprising at least one pigment which is photoluminescent under illumination by said second source of non-visible light,
- a layer, named filtering layer 7, is arranged facing said second image and comprises at least one material, named filtering material, suitable for allowing the wavelengths emitted by said first source 20 of non-visible light to be filtered without preventing the first image 5 from being seen under illumination by the first light source.

The order of printing the first image and the second image can vary depending on whether each of the three preceding layers were applied successively on a support film or directly on a document to be protected or whether the filtering layer forms a support film.

If the document is a card (e.g. a card comprising at least one polycarbonate layer), the second image 9 can be placed directly on said card or on a film made of polycarbonate, PVC or even PET, which is then itself placed onto said card. In this latter case, the first image 5 will preferably have been placed onto a face of said film made of polycarbonate, PVC or PET (said face being opposite to that on which the second image 9 is placed).

FIG. 2 shows an official document 15 on which the security film 1 was thus transferred after having removed the protective film 12 from the adhesive layer 10. Once the security film 1 is arranged on the official document 15, the support film 2 used as a transfer support film is likewise removed. If present, the protective lacquer 4 thus allows the first polychromatic image 5 to be protected against external events, in particular chemical attacks and climate changes, and likewise increases the resistance thereof to mechanical stresses.

The support film 2 can be, for example, a Fasprotek™ (FASVER, Baillargues, France)-type film.

Alternatively, the support film 2 can likewise comprise a single layer (not supported by a support and without a protective lacquer layer 4), e.g. a Fasfilm™ (FASVER, Baillargues, France)-type film. In this case, the continuous layer is, for example, formed of polyethylene terephtalate, of polycarbonate or of polyvinyl chloride and can be used as a filtering layer, the first polychromatic image being printed on a first support face and the second polychromatic image being printed on a second face of the support different from the first face. Therefore, the first image and the second image are printed respectively on one side and on the other side of the support film made of polyethylene terephtalate, of polycarbonate or of polyvinyl chloride and filtering short-wave ultraviolet light. Furthermore, in this latter case, the adhesive layer is not necessary to allow the transfer by hot lamination of the security film 1 to a surface portion of an official document 15.

The photoluminescent pigments used are selected from among fluorescent pigments and phosphorescent pigments. In particular, the photoluminescent pigments used are selected from among mineral pigments, in particular photoluminescent pigments comprising chemical elements belonging to the family of rare earth metals, and organic pigments resistant to the radiation of each source of non-visible light allowing the behaviour of each image over time to be ensured.

FIGS. 3 to 5 show an official document 15 (e.g. an identity card) to which the security film as prepared previously is transferred.

FIG. 3 shows the official document 15 as seen under illumination in visible light (daylight for example). The images 5 and 9 comprise photoluminescent pigments which are thus not visible.

The official document 15 has markings 17, in particular identity data. The markings 17 located on the official document 15 are preferably black and in particular of a colour (or shade) different from the colours of the patterns of the semi-transparent polychromatic images covering them, so that the markings can be easily distinguished by the naked eye (under illumination by a source of non-visible light in short-wave and/or long-wave ultraviolet light).

FIG. 4 shows the official document 15 under short-wave ultraviolet light owing to the source 20 of non-visible light. The image 5 can now be seen (and represents, for example, a pattern such as a butterfly). The image 5 which can be seen under illumination by the source 20 of light emitting in the short ultraviolet domain, emitting in particular at a wavelength in the order of 250 nm, is of a very high quality and allows the details of the represented pattern and its different colours to be clearly distinguished. In particular, no light emission from the underlying image 9 interferes with the viewing of the image 5.

FIG. 5 shows the official document 15 under long-wave ultraviolet light owing to the source 22 of non-visible light. Only the image 9 can now be seen (and represents, for example, a pattern such as a flower). The image 9 which can be seen under illumination by the source 22 of light emitting in the long ultraviolet domain, emitting in particular at a wavelength in the order of 365 nm, is of a very high quality and allows the details of the represented pattern and its different colours to be clearly distinguished.

EXAMPLE 1

A support film which is transparent to short-wave and long-wave ultraviolet light and is formed of polystyrene, as sold by the company VITASHEET GROUP (Italy) under reference Robbex 515PH® is selected. A protective lacquer made of polyurethane is printed on this support film and was formed from an aqueous solution comprising a transfer lacquer base sold by TIFLEX (France) under reference 3X9426® and a curing agent with reference 3X9427®. The proportion of curing agent added is 45 parts by volume for 100 parts by volume of the base. This printing is effected in a block of colour by screen printing with a mesh of 51 threads/cm so that the applied protective lacquer layer has a thickness between 10 μm and 20 μm.

A first image is printed on this protective lacquer using three different printing compositions, each being formulated from an ink base suitable for not filtering short-wave ultraviolet light such as an ink base sold by the company TIFLEX (France) under reference LG 111104 Solubilis®. The first printing composition comprises blue fluorescent pigments such as those sold by the company MITSUBISHI CHEMICAL CORPORATION (Japan) under reference KX-626A®. The second printing composition comprises red fluorescent pigments such as those sold by the company HONEYWELL under reference Lumilux Red CD106®. The third printing composition comprises green fluorescent pigments such as those sold by the company HONEYWELL under reference Lumilux Green CD145®. This first image contains fluorescent pigments which are visible under short-wave ultraviolet light.

The concentration of blue fluorescent pigments in the first printing composition is 50% by weight relative to the total weight of the first printing composition. The concentration of red fluorescent pigments in the second printing composition is 16.5% by weight relative to the total weight of the second printing composition. The concentration of green fluorescent pigments in the third printing composition is 15% by weight relative to the total weight of the third printing composition.

Following the three printing layers forming the first image which is visible under short-wave ultraviolet light, there is printed a polyurethane-based lacquer comprising a lacquer base such as that sold by the company TIFLEX (France) under reference 3Y0530 vernis S3HN1® (screen printing product) and a catalyst such as that sold by the company TIFLEX (France) under reference 3X9096®. The proportion of catalyst added is 53 parts by volume for 100 parts by volume of the lacquer base. The printing is effected in a block of colour by screen printing with a mesh of 77 threads/cm so that the applied protective lacquer layer has a thickness between 8 μm and 12 μm. A lacquer layer filtering short-wave ultraviolet light is thus obtained.

A second image is printed on this filter using three different printing compositions. The first printing composition is a UVIPRIM® ink sold by the company TIFLEX (France) under reference 3Y1150 Bleu®. The second printing composition is a UVIPRIM® ink sold by the company TIFLEX (France) under reference 3Y0742 Rouge®. The third printing composition is a UVIPRIM® ink sold by the company TIFLEX (France) under reference 3Y0877 Vert®. This second image contains fluorescent pigments which are visible under long-wave ultraviolet light.

Each layer is allowed to dry between each printing step.

Then, a heat-sealable adhesive sold by the company TIFLEX under reference 3Y1836NF® (screen printing product) is applied.

Only the first image is observed under illumination by a source of light emitting in the short ultraviolet domain at a wavelength in the order of 250 nm. Only the second image is observed under illumination by a source of light emitting in the long ultraviolet domain at a wavelength in the order of 365 nm.

The invention can comprise a large number of embodiment variants. In particular, it is possible to provide an additional image comprising photoluminescent pigments which are invisible under illumination in visible light and are visible under illumination by at least one infrared light source.

The invention claimed is:

1. A security film, comprising:

at least one first image which is invisible under illumination in visible light and is visible under illumination by at least one first source of non-visible light emitting in a short ultraviolet domain, said first image comprising at least one pigment which is photoluminescent under illumination by said first source of non-visible light, wherein the security film further comprises:

at least one second image which is invisible under illumination in visible light and is visible under illumination by at least one second source of non-visible light emitting in a long ultraviolet domain, said second image comprising at least one pigment which is photoluminescent under illumination by said second source of non-visible light, at least one filtering layer, arranged facing said second image and comprising at least one filtering material suitable for allowing the non-visible light emitted by said first source of non-visible light to be filtered without preventing the first image from being seen under illumination by the first light source, further comprising at least one support film on which are arranged said first image and said second image, said filtering layer being arranged between said first image and said second image.

2. The security film according to claim 1, wherein said second image is arranged on top of said first image on said support film.

3. The security film according to claim 1, wherein said support film is transparent.

4. A security film, comprising:

at least one first image which is invisible under illumination in visible light and is visible under illumination by at least one first source of non-visible light emitting in a short ultraviolet domain, said first image comprising at least one pigment which is photoluminescent under illumination by said first source of non-visible light, wherein the security film further comprises:

at least one second image which is invisible under illumination in visible light and is visible under illumination by at least one second source of non-visible light emitting in a long ultraviolet domain, said second image comprising at least one pigment which is photoluminescent under illumination by said second source of non-visible light, at least one filtering layer, arranged facing said second image and comprising at least one filtering material suitable for allowing the non-visible light emitted by said first source of non-visible light to be filtered without preventing the first image from being seen under illumination by the first light source, wherein said filtering layer forms a support film having a first face on which is arranged said first image, and a second face, different from said first face, on which is arranged said second image.

5. A protective security method for at least one surface portion of a document, in which at least one first image which is invisible under illumination in visible light and is visible under illumination by at least one first source of non-visible light emitting in a short ultraviolet domain is applied to said surface portion, said first image comprising at least one pigment which is photoluminescent under illumination by said first source of non-visible light, wherein at least one second image which is invisible under illumination in visible light and is visible under illumination by at least one second source of non-visible light emitting in a long ultraviolet domain is applied to said surface portion, said second image comprising at least one pigment which is photoluminescent under illumination by said second source of non-visible light, and a filtering layer superposed on said second image and comprising at least one filtering material suitable for allowing the non-visible light emitted by said first source of non-visible light to be filtered without preventing the first image from being seen under illumination by the first light source, wherein the first image is printed on a support film, the filtering layer is applied on top of the first image, the second image is printed on top of the filtering layer, an adhesive layer is applied on top of the second image.

6. The method according to claim 5, wherein each image is printed by a technique selected from screen printing, flexography, offset and photogravure.

7. A protective security method for at least one surface portion of a document, in which at least one first image which is invisible under illumination in visible light and is visible under illumination by at least one first source of non-visible light emitting in a short ultraviolet domain is applied to said surface portion, said first image comprising at least one pigment which is photoluminescent under illumination by said first source of non-visible light, wherein at least one second image which is invisible under illumination in visible light and is visible under illumination by at least one second source of non-visible light emitting in a long ultraviolet domain is applied to said surface portion, said second image comprising at least one pigment which is photoluminescent under illumination by said second source of non-visible light, and a filtering layer is superposed on said second image and comprising at least one filtering material suitable for allowing the non-visible light emitted by said first source of non-visible light to be filtered without preventing the first image from being seen under illumination by the first light source, wherein, in order to apply each image, a plurality of superposed, monochromatic printing layers are printed such that, in an order of receiving the illumination light, they are in an order of blue, red, green of filtering wavelengths and emission peaks of photoluminescent pigments.

* * * * *